US007399191B1

(12) United States Patent
Scholeno

(10) Patent No.: US 7,399,191 B1
(45) Date of Patent: Jul. 15, 2008

(54) SOCKET BODY

(75) Inventor: Michael F. Scholeno, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/982,934

(22) Filed: Nov. 6, 2007

(51) Int. Cl.
*H01R 33/08* (2006.01)

(52) U.S. Cl. ..... 439/232; 439/226; 439/336

(58) Field of Classification Search ..... 439/220, 439/226, 232, 182, 336
See application file for complete search history.

(56) References Cited

U.S. PATENT DOCUMENTS

| | | | | |
|---|---|---|---|---|
| 3,955,872 | A * | 5/1976 | Brudy | 439/384 |
| 4,101,187 | A * | 7/1978 | Collier | 439/602 |
| 5,120,242 | A * | 6/1992 | Greiler et al. | 439/683 |
| 6,332,796 | B1 * | 12/2001 | Chen | 439/226 |
| 7,097,489 | B2 * | 8/2006 | Yen et al. | 439/336 |
| 7,303,433 | B1 * | 12/2007 | Scholeno et al. | 439/552 |

* cited by examiner

*Primary Examiner*—Briggitte R Hammond
(74) *Attorney, Agent, or Firm*—William H. MsNeill

(57) ABSTRACT

A lamp socket (10) has first and second cylindrical body halves (12, 14) respectively. The first body (12) half has a first outer surface (16) and a first inner mating surface (18), the first inner mating surface (18) including a first depression (19). An insulating sheet (20) is positioned adjacent the inner mating surface (18). A plug (22) is fitted into the first depression (19) and includes a flange (24) that overlies the insulating sheet (20) and maintains the insulating sheet (20) in contact with the first inner mating surface (18). The second body half (14) has a second outer surface (26) and a second inner mating surface (28) and includes a second depression (30). The second body half (14) overlies the first body half (12) with the mating surfaces (18, 28) adjacent one another with the insulating sheet (20) held therebetween. The second depression (30) encompasses the flange (24). A dual function retainer (32) holds the various pieces together and comprises a tubular member (34) extending from the first body half outer surface (16) though the plug (22), the tubular member (34) being deformed at its inner terminus (36) to thereby maintain the plug (22) in position in the depression (19); and a threaded member (37) extends through the tubular member (34) and through an aperture (38) in the second body half (14). Means (40) on the threaded member (37) retain the first and second body halves (12, 14), together. In an alternate embodiment, the tubular member (34) is threaded, thus eliminating the need for a washer and nut.

5 Claims, 3 Drawing Sheets

SOCKET BODY

TECHNICAL FIELD

This invention relates to lamp sockets and more particularly to lamp sockets for lamps of very high power.

BACKGROUND ART

U.S. pending patent application Ser. No. 11/583,471, filed Oct. 19, 2006, the teachings of which are hereby incorporated by reference, relates to a lamp socket that will accept lamps from either a front or rear loading position. The lamp socket described in the above-cited patent application works extremely well with lamps operated at 10 KV. However, it would be an advance in the art if sockets that will accept hot-restart lamps that operate at voltages up to 30 KV could be provided. Such sockets require superb electrical insulation to prevent the formation of arc paths that could lead to other parts of the socket or to the final fixture.

DISCLOSURE OF INVENTION

It is, therefore, an object of the invention to obviate the disadvantages of the prior art.

It is another object of the invention to enhance high wattage sockets.

These objects are accomplished, in one aspect of the invention, by a lamp socket comprising: first and second cylindrical body halves; the first body half having a first outer surface and a first inner mating surface, the first inner mating surface including a first depression; an insulating sheet adjacent the inner mating surface; a plug fitted into the first depression, the plug including a flange that overlies the insulating sheet and maintains the insulating sheet in contact with the first inner mating surface; the second body half having a second outer surface and a second inner mating surface and including a second depression, the second body half overlying the first body half with the mating surfaces adjacent one another with the insulating sheet held therebetween, the second depression encompassing the flange; and a dual function retainer comprising a tubular member extending from the first body half outer surface though the plug, the tubular member being deformed at its inner terminus to thereby maintain the plug in position; and a threaded member extending through the tubular member and through an aperture in the second body, and means on the threaded member for retaining the first and second body halves together.

In an embodiment of the invention, the first cylindrical body half includes electrical contacts and the insulating sheet maintains the electrical contacts in a position to receive lamp contacts. The electrical contacts include a wire engager for receiving the connection to an outside power supply. The first inner mating surface includes at least one groove that mates with at least one land formed on the second mating surface. Thus, all wire connections are made within the socket and electrical paths are increased.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
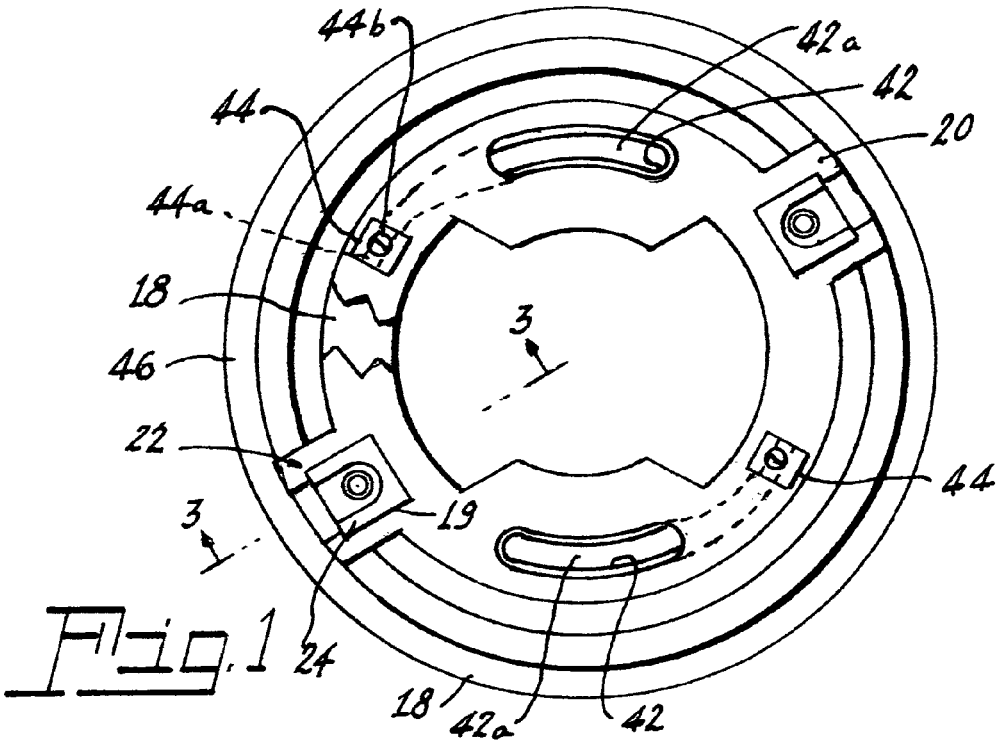
FIG. 1 is a plan view of a first socket half.
Figure 2:
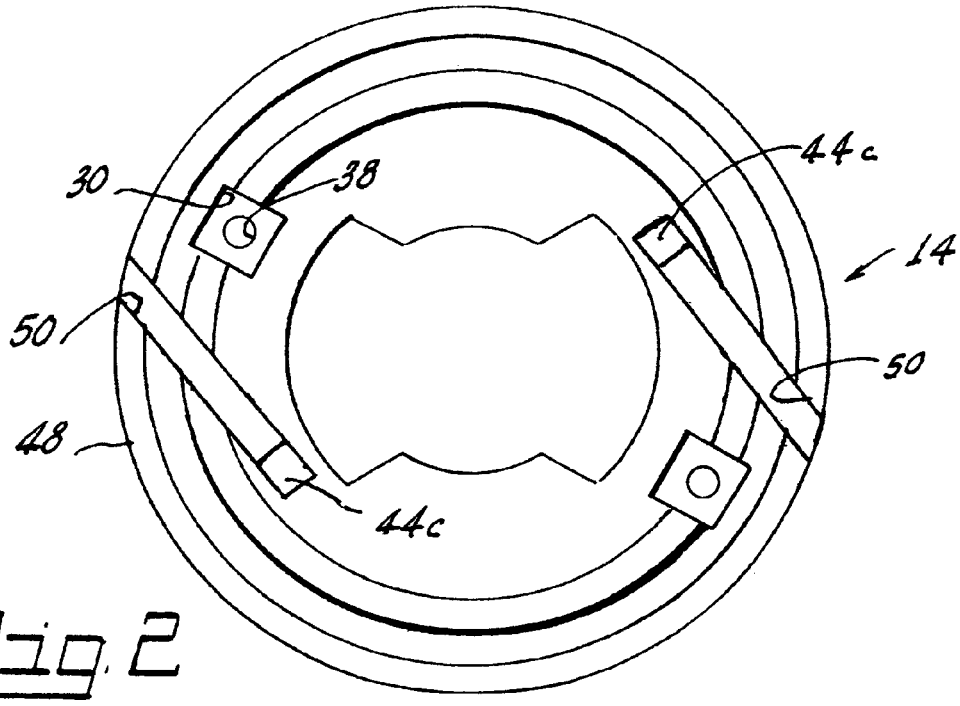
FIG. 2 is a plan view of a second socket half.
Figure 3:
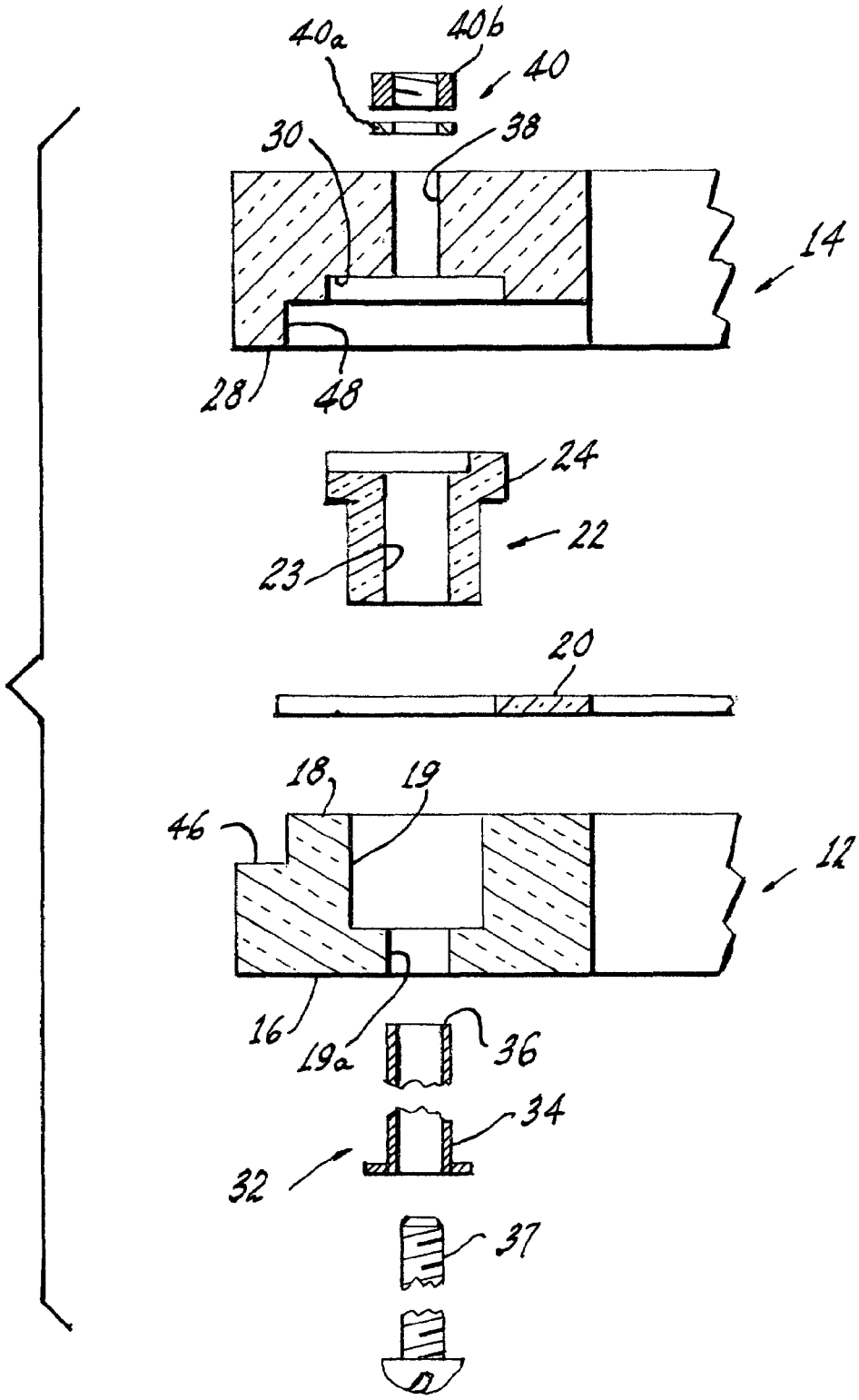
FIG. 3 is an exploded, sectional view of a socket according to an aspect of the invention.

Referring now to the drawings with greater particularity, there is shown in FIG. 3 a lamp socket 10 comprising first and second cylindrical body halves 12, 14 respectively. The body halves are formed of a suitable high voltage ceramic material, such as, for example, steatite.

The first body half 12 has a first outer surface 16 and a first inner mating surface 18, and the first inner mating surface 18 includes a first depression 19. An insulating sheet 20 is positioned adjacent the inner mating surface 18.

A plug 22 having a substantially cubic configuration is fitted into the first depression 19. The plug 22 includes a flange 24 that overlies the insulating sheet 20 and maintains the insulating sheet 20 in contact with the first inner mating surface 18. An aperture 23 extends through the plug 22.

Figure 4:
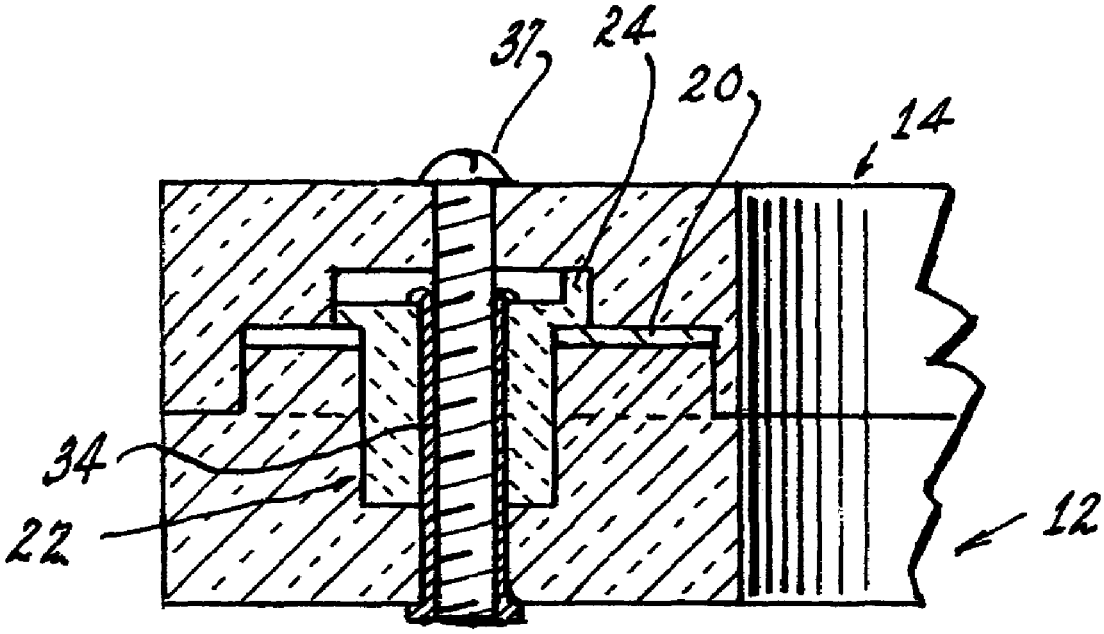
FIG. 4 is a partial sectional view of an assembled socket.

The second body half 14 has a second outer surface 26 and a second inner mating surface 28 and includes a second depression 30. The second body half 14 overlies the first body half 12 with the mating surfaces 18, 28 adjacent one another with the insulating sheet 20 held therebetween, the second depression 30 encompassing the flange 24, as best seen in FIG. 4.

A dual function retainer 32 comprises a tubular member 34 of, for example, brass or other suitable material, that extends from the first body half outer surface 16 though the aperture 23 in the plug 22, the tubular member 34 being deformed at its inner terminus 36 to thereby maintain the plug 22 in position in the depression 19. A threaded member 36, for example, a bolt, extends through the tubular member 34 and through an aperture 38 in the second body half 14, and means 40, for example, a washer 40*a* and a nut 40*b* on the threaded member 36, secure the first and second body halves 12, 14, together. Alternatively, the tubular member 34 can be threaded, thus eliminating the need for the washer 40*a* and the nut 40*b*, as shown in FIG. 4.

The first cylindrical body half 12 includes electrical contacts 42 positioned in spaces 42*a* and the insulating sheet 20 maintains the electrical contacts 42 in position to receive lamp contacts. During assembly of the socket 10, contacts 42 are placed in the spaces 42*a*, insulating sheet 20 is placed in engagement with the mating surface 18, plug 22 is positioned within the depression 19 with its flange 24 engaging and holding the insulating sheet 20 (and the contacts 42 in position), tubular member 34 is fitted through apertures 19*a* and 23 and the terminus 36 is deformed, thus holding all of the parts in the desired location.

The electrical contacts 42 include a wire engager 44 including a wire receiving aperture 44*a* and wire fixing means 44*b*, such as a screw. If necessary, a second depression 44*c* can be provided in the second body half 14 to receive the wire engager 44 and, preferably, the second depression is formed at the end of a wire ingress channel 50.

Thus there is provided a high wattage lamp socket with potential arc paths lengthened and open holes eliminated. After the wire connections are made to the wire engagers 44 and the second body half 14 is attached to the first body half 12, the socket 10 provides a safe environment for wattages up to 30 KV.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A lamp socket comprising:

first and second cylindrical body halves;

said first body half having a first outer surface and a first inner mating surface, said first inner mating surface including a first depression;

an insulating sheet adjacent said inner mating surface;

a plug fitted into said first depression, said plug including a flange that overlies said insulating sheet and maintains said insulating sheet in contact with said first inner mating surface;

said second body half having a second outer surface and a second inner mating surface and including a second depression, said second body half overlying said first body half with said mating surfaces adjacent one another with said insulating sheet held therebetween, said second depression encompassing said flange; and a dual function retainer comprising a tubular member extending from said first body half outer surface though said plug, said tubular member being deformed at its inner terminus to thereby maintain said plug in position; and a threaded member extending through said tubular member and through an aperture in said second body, and means on said threaded member for retaining said first and second body halves together.

2. The lamp socket of claim 1 wherein said first cylindrical body half includes electrical contacts and said insulating sheet maintains said electrical contacts in a position to receive lamp contacts.

3. The lamp socket of claim 2 wherein said electrical contacts include a wire engager.

4. The lamp socket of claim 3 wherein said first inner mating surface includes at least one groove.

5. The lamp socket of claim 4 wherein said second mating surface includes at least one land that mates with said at least one groove.

* * * * *